US007703953B2

(12) United States Patent
Müller

(10) Patent No.: US 7,703,953 B2
(45) Date of Patent: Apr. 27, 2010

(54) SKID DEVICE FOR SPOTLIGHTS

(75) Inventor: Timo Müller, Stephanskirchen (DE)

(73) Assignee: Arnold & Richter Cine Technik GmbH & Co. Betriebs KG, Munich (DE)

( * ) Notice: Subject to any disclaimer, the term of this patent is extended or adjusted under 35 U.S.C. 154(b) by 0 days.

(21) Appl. No.: 11/990,819

(22) PCT Filed: Aug. 23, 2006

(86) PCT No.: PCT/EP2006/008283

§ 371 (c)(1),
(2), (4) Date: Feb. 21, 2008

(87) PCT Pub. No.: WO2007/022967

PCT Pub. Date: Mar. 1, 2007

(65) Prior Publication Data

US 2008/0253137 A1 Oct. 16, 2008

(30) Foreign Application Priority Data

Aug. 23, 2005 (DE) ..... 20 2005 013 537 U

(51) Int. Cl.
*F21V 21/00* (2006.01)

(52) U.S. Cl. ..... 362/398; 248/146; 248/158; 248/127; 362/382

(58) Field of Classification Search ..... 362/389; 248/158, 146, 127
See application file for complete search history.

(56) References Cited

U.S. PATENT DOCUMENTS

| | | | | |
|---|---|---|---|---|
| 4,061,912 | A | 12/1977 | Levasseur | |
| 4,141,523 | A | 2/1979 | Brendgens | |
| 5,195,823 | A * | 3/1993 | Sidabras | 362/387 |
| 5,695,278 | A * | 12/1997 | Grossman et al. | 362/374 |
| 6,120,164 | A * | 9/2000 | Libin et al. | 362/269 |
| 6,386,738 | B1 * | 5/2002 | Staudacher | 362/374 |
| 6,824,297 | B1 | 11/2004 | Lee | |

FOREIGN PATENT DOCUMENTS

| | | |
|---|---|---|
| CA | 2 388 786 A1 | 12/2003 |
| DE | 77 33 037 U1 | 4/1978 |

(Continued)

OTHER PUBLICATIONS

International Search Report, dated Nov. 8, 2006, corresponding to PCT/EP2006/008283.

(Continued)

*Primary Examiner*—Jong-Suk (James) Lee
*Assistant Examiner*—Julie A Shallenberger
(74) *Attorney, Agent, or Firm*—Christie, Parker & Hale LLP

(57) ABSTRACT

The invention relates to a skid device (6) for spotlights with skids (7, 8), which extend essentially parallel to the optical axis of the spotlight, and cross members (11, 12), which connect the skids (7, 8) to one another and which serve to hold a bottom section of the spotlight housing (3). The invention provides that at least one skid (7, 8) has a section (73 to 75, 83 to 85) situated at an angle to the center longitudinal axis (M) of the spotlight housing (1, 3).

15 Claims, 3 Drawing Sheets

FOREIGN PATENT DOCUMENTS

| | | | |
|---|---|---|---|
| DE | 298 19 688 | U1 | 2/1999 |
| EP | 0 997 684 | A2 | 5/2000 |
| EP | 0 997 684 | A3 | 5/2000 |
| FR | 2 363 267 | | 3/1978 |

OTHER PUBLICATIONS

English Translation of International Preliminary Examination Report, with Written Opinion, for corresponding International Application No. PCT/EP2006/008283, dated Apr. 8, 2008.

* cited by examiner

SKID DEVICE FOR SPOTLIGHTS

The invention relates to a skid device for spotlights, that is to say for stage, studio, film, television or event spotlights, according to the preamble of claim 1.

Spotlights can be used via a pole operation with or without a motor-driven remote control, both when standing while connected to a stand and when hanging while connected to a studio suspension known as a rig. The connection of the spotlight to a stand or a rig is carried out with a bow, which can pivot about the spotlight housing for the standing or hanging attachment of the spotlight and whose bow arms are connected to the spotlight housing via bow linkages arranged diametrically opposite one another. The bow, which can be pivoted about one transverse axis of the spotlight housing, can be fixed in an arbitrary position relative to the horizontal by means of a clamping device, so that the inclination of the spotlight to the stand or the rig can additionally be changed.

For the transportation, but in particular for the setting-down of a spotlight, a skid device is provided and connected to the base area of the spotlight housing, so that the spotlight set down onto an underlying surface which takes up a stable position. The skid device comprises two skid s parallel to the central longitudinal axis or parallel to the optical axis of the spotlight, generally running along both sides of the spotlight housing and whose ends are connected to one another via cross tubes as well as at least two cross members which connect the skids to one another and are connected to the spotlight, preferably to the base area or to a base pan of the spotlight housing. For transportation of the spotlight, the cross tubes are angled from the skids in the direction of the spotlight housing, so that they are at a sufficient spacing from an underlying surface and can accordingly easily be gripped.

A cable bushing is provided on one of the housing sides of the spotlight to supply the spotlight with electricity and to control it, through which cable bushing one end of the spotlight cable is inserted into the interior of the spotlight, while the other end of the spotlight cable is connected to an electricity supply, a control panel, a ballast or such like via a coupling.

In the case of using the spotlight in connection with a stand, the bow connected to the spotlight housing is folded downward, that is to say under the base area of the spotlight, and connected to a receptacle of the stand. Since both the bow arms and also the skids of the skid device project only slightly beyond the side walls of the spotlight housing in order to save space, the spacing of the skids from one another has to be chosen in such a way that the bow can be pivoted into the stand position without there being the risk of a collision with the skids. However, the spacing then remaining between the bow arms and the skids is, in the case of appropriate dimensioning of the skid device and the bow, and allowing for a small lateral projection beyond the spotlight housing, not sufficient to lead the spotlight cable through it, so that additional manipulations are required to lay the spotlight cable without the risk of squashing it between skid and bow arm.

However, in many applications, in particular in the case of hasty manipulation, a squash-free leading of the spotlight cable is not ensured, so that there is the risk of damaging the spotlight cable and of a short circuit, with a consequent threat to operating personnel or the electricity supply and control apparatus.

The same risk exists, if the inclination of the spotlight is changed in the standing position of the spotlight, so that a relative movement occurs between the bow connected to the stand and the skid device connected to the base area of the spotlight. Due to the spotlight cable being led close to the spotlight housing the risk exists thereby, that said cable is pinched between the bow arms and the skids of the skid device, in which case, as a result of the squashing of the spotlight cable, there is the additional risk of damage to the spotlight cable or the spotlight during an attempt at pulling out the spotlight cable.

It is therefore the object of the present invention to be able to lay the spotlight cable connected to the spotlight without the risk of damage and in an unproblematic and reliable manner independently of the position of a bow connected to the spotlight housing.

This object is achieved according the invention by the features of claim 1.

The solution according to the invention ensures an unproblematic and reliable laying of the spotlight cable independently of the respective bow position and thus without risk of damaging the spotlight cable during pivoting of the bow or adjustment of the inclination of the spotlight.

The solution according to the invention can in principle be applied to one or both skids of the skid device, the angling of the central region of the skid arranged on the side of the spotlight bushing sufficing in principle because of the leading through of the spotlight cable on one side of the spotlight housing.

For reasons of symmetry and to ensure universal use of the skid device independently of the type of spotlight and the respective arrangement of the cable bushing, the angled section is preferentially arranged on both skids.

By arranging the angled section between the end sections of the skid or skids it is ensured that the spotlight cable led through between the skid device and the bow has enough play in the longitudinal direction of the spotlight housing.

In one preferred embodiment, the angled section has first and second subsections departing obliquely from the end sections, and a third subsection, running parallel to the end sections, arranged between the first and second subsections.

By arranging oblique subsections between the end sections and the subsection of the angled section that run parallel to the end sections, a soft transition is created from the end sections to the angled section. However, alternatively a rectangular angling can also be provided at the transition from the end sections to the angled section.

The skids can serve as a base rest over their entire length or only over the length of their end sections, in which case when only the end sections are a base rest the angled section is angled in the direction of the optical axis of the spotlight and thus led at a spacing from a base rest.

Since the skids of the skid device are connected to one another via the cross members connected to the spotlight housing via a screw or plug-in connection, no additional connection of the skid ends is required. Alternatively, a connection of the ends of the skids via cross tubes can be provided for the formation of a skid frame, which cross tubes run parallel to the cross members in a further preferred embodiment and are preferably angled in the direction of the optical axis of the spotlight housing, so that when the spotlight is set down onto a base rest, the cross tubes are at a spacing from the base rest and can easily be gripped for transportation of the spotlight. For further simplification of the handling, the cross tubes project above the base area of the spotlight housing and are, like the skids, made of metal tubes which ensure both great stability and optimal handling.

The invention and further features and advantages of the invention are to be explained in greater detail with reference to an exemplary embodiment illustrated in the drawing, in which:

FIG. 1 shows a perspective view of a spotlight with a spotlight housing, made from a cylindrical lamp housing 1 and a cuboidal or polygonal base pan 3 with a front and rear side cover.

Figure 1:
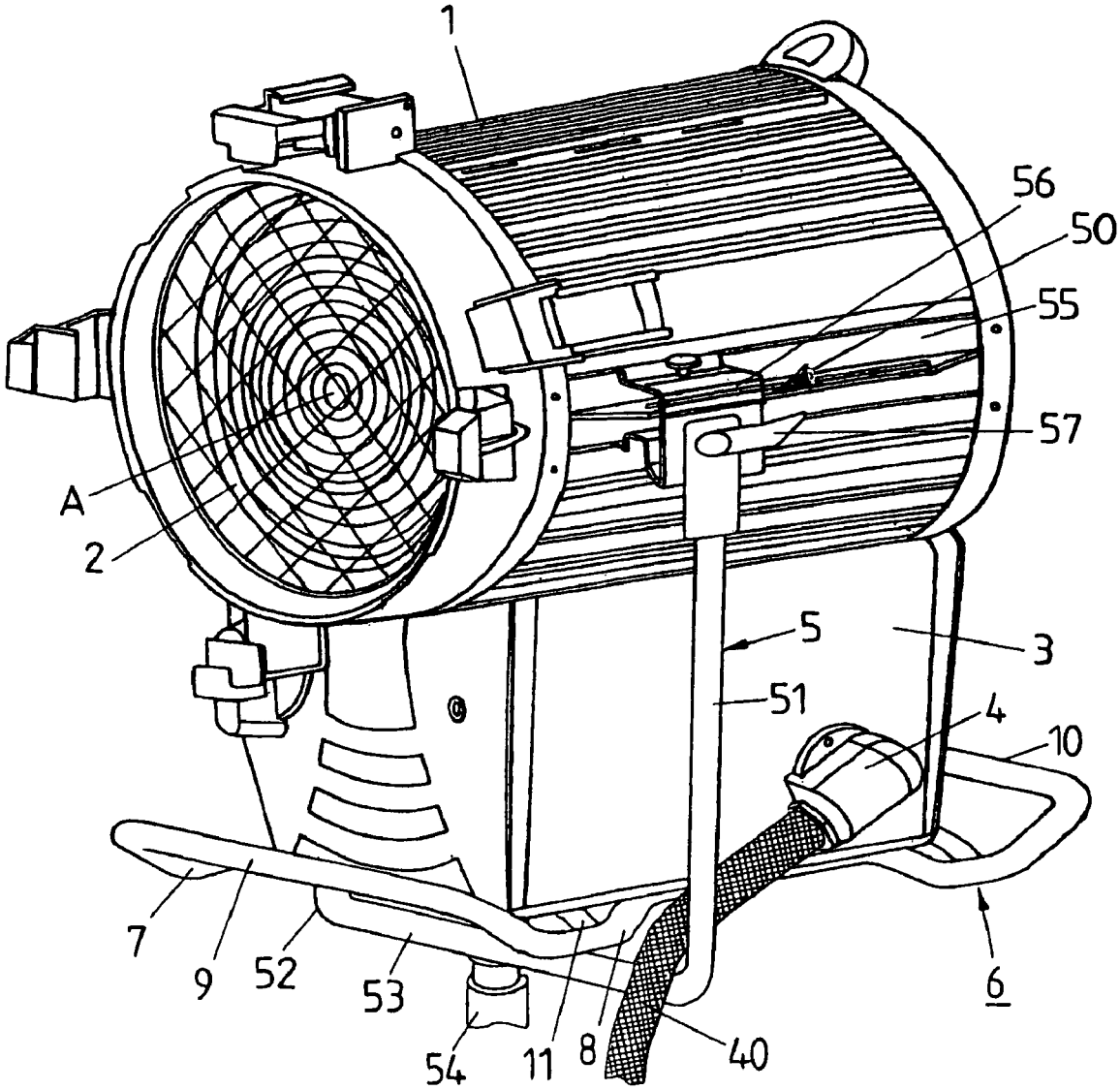
FIG. 1 shows a perspective view of a spotlight with bow linked to the spotlight housing, and a skid device.

The front side cover is connected to an attachment part 2, which is linked to the cylindrical lamp housing 1 and can be braced to it via a bow fastener, and into which a lens disk with a wire mesh, if appropriate, is inserted, and which comprises claws to hold attachment elements such as diffusers, filter disks, protection disc or such like.

To connect the spotlight to a stand for the standing arrangement of the spotlight or to a rig to hang the spotlight, a bow 5 is provided, which has two bow arms 51, 52, the ends of which are connected to bow linkages 50 arranged diametrically opposite one another on the cylindrical lamp housing 1, a connecting arm 53 connecting the bow arms 51, 52 and a connecting pin 54, which is arranged centrally on the connecting arm 53. The bow linkages 50 comprise a housing rail 55, which is connected to the cylindrical lamp housing 1 or formed from profiled parts of the cylindrical lamp housing 1, and a bow bearing 56, connected to the ends of the bow arms 51, 52, which is connected to the housing rail 55 with positive locking and can be adjusted on the housing rail 55 in the longitudinal direction, that is to say in the direction of the optical axis A of the spotlight, and can be connected to the housing rail 55 in selected positions with positive and/or non-positive locking by means of a clamping lever 57.

To adjust the inclination of the spotlight, the bow linkage 50 can be unfastened by operating the clamping lever 57, and the spotlight housing 1, 3 can be brought into the desired inclined position. Subsequently, the clamping lever 57 is operated again to fix the bow linkage 50, in order to fix the desired inclination setting.

On the base pan 3 of the spotlight a cable bushing 4 is provided, via which the spotlight is connected to a spotlight cable 40. The cable bushing 4 is formed in such a manner, that the spotlight cable 40 can be led out of the cable bushing 4 parallel to the surface of the spotlight housing 1, 3. Said bushing is preferably arranged so that it can rotate on the spotlight housing 1, 3, so that its alignment can be changed depending on the standing or hanging connection of the spotlight to a stand or a rig.

In the position shown in FIG. 1, the cable bushing 4 is in a standing setting, in which the cable bushing 4 points obliquely with its opening to a base area 30 of the spotlight housing 1, so that, in the case of positioning the spotlight by means of the bow 5, the spotlight cable 40 is led out of the cable bushing 4 toward the stand. In the case of fastening the spotlight on a rig, the cable bushing 4 can be rotated by 180° so that in a rig setting the cable bushing 4 points obliquely upward approximately in the direction of the rear side of the spotlight housing 1, 3.

The base pan 3 is connected to a skid device 6 which is assembled from two skids 7, 8 running parallel to the sides of the base pan 3, two cross tubes 9, 10 connecting the ends of the skids 7, 8 to one another and two cross members 11, 12, which also connect the skids 7, 8 to one another and of which only a part of the front cross member 11 can be seen in FIG. 1. The cross members 11, 12 have reception or fastening elements to connect the skid device 6 to the base pan 3 or the spotlight housing 1, while the cross tubes 9, 10, are connected, aligned obliquely upward, to the ends of the skids 7, 8, so that in the case of setting down the spotlight onto an underlying surface, the cross tubes 9, 10 are spaced from the underlying surface and can easily be gripped.

Both the bow arms 51, 52 of the bow 5, as well as the skids 7, 8 of the skid device 6 are only at a small spacing from the sides of the spotlight housing 1 for reasons of space and stability, the spacing of the skids 7, 8 from one another being smaller than the spacing of the bow arms 51, 52 of the bow 5, so that the bow 5 can be pivoted without a problem into the stand setting illustrated in FIG. 1. However, in this position the spacing between the bow arms 51, 52 of the bow 5 and the skids 7, 8 is only formed as a small gap, through which the spotlight cable 40 cannot be led or can be so led with difficulty, since it requires a prescribed minimum cable cross section due to the high currents required to operate the spotlight.

Therefore, during a pivoting the bow 5 into the stand setting, the positioning of the spotlight cable 40 is a difficult and cumbersome operation, there being the risk of squashing the spotlight cable 40 between the skid 8 and the bow 5.

According to the invention, the skid device 6 has, in the area of the central section of the skids 7, 8, a section which is angled to the respective other skid 7, 8, can be seen in the perspective illustration shown in FIG. 1. Further details of the configuration of the skid device 6 can be taken from the individual illustration of the skid device 6 according to FIG. 2 and will be explained in more detail below.

Figure 2:
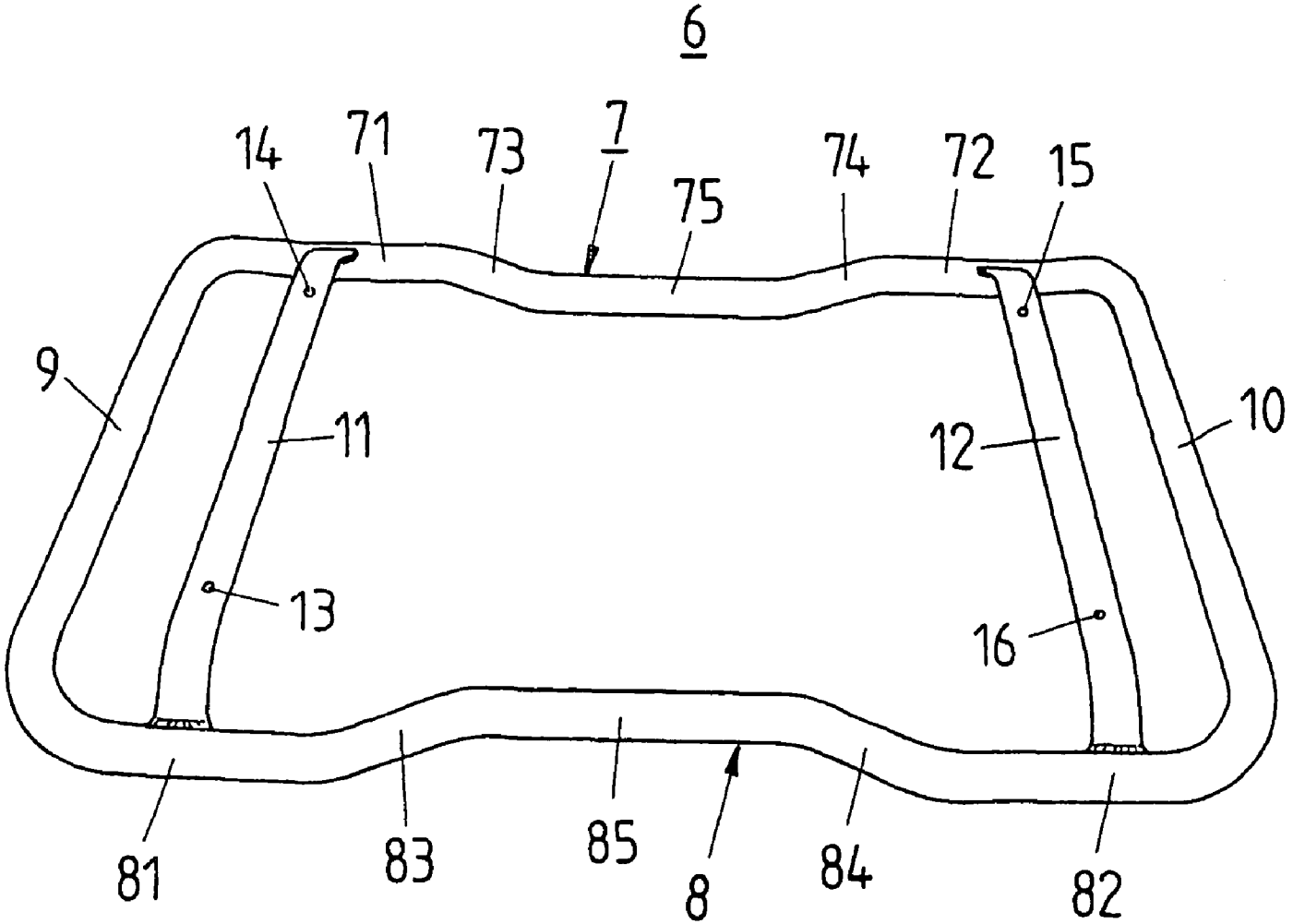
FIG. 2 shows a perspective view of the skid device with angled skid sections and FIG. 3 shows a perspective base view of the spotlight with skid device and a bow pivoted into the stand position.

FIG. 2 shows a schematic perspective illustration of the skid device 6 according to the invention, which is assembled as a circumferential skid frame from skids 7, 8, running parallel to one another, and cross tubes 9, 10, connecting the ends of the skids 7, 8 to one another. The skids 7,8 are comprised of end sections 71, 72 and 81, 82, between which there are formed the angled sections 73, 74, 75 and 83, 84, 85 which are assembled from first and second subsections 73, 74 and 83, 84 and a third section 75, 85, lying therebetween and running parallel to the end sections 71, 72 and 81, 82, and which form a wasted section of the skids 7, 8 in relation to one another.

Bow-shaped cross members 11,12 are connected to the end sections 71, 72 and 81, 82 of the skids 7, 8 and have bores 13, 14, 15, 16, through which the fastening means are inserted and connected to the base pan 3 according to FIG. 1.

As a result of the bow-shape, both the cross members 11, 12 and the cross tubes 9, 10 which are offset toward the top are at a spacing from a base rest, while the skids 7, 8 lie on a rest area over their entire length in the embodiment illustrated in FIG. 2.

As an alternative to the embodiment of a skid device illustrated in FIG. 2, the oblique sections 73, 74 and 83, 84 can also be formed as connection parts which are rectangularly angled from the end sections 71, 72 and 81, 82.

While the skids 7, 8 and also the cross tubes 9, 10 are formed as steel tubes, the cross members 11, 12 are made of band-shaped steel elements and are preferably welded onto the end sections 71, 72 and 81, 82 of the skids 7, 8.

Figure 3:
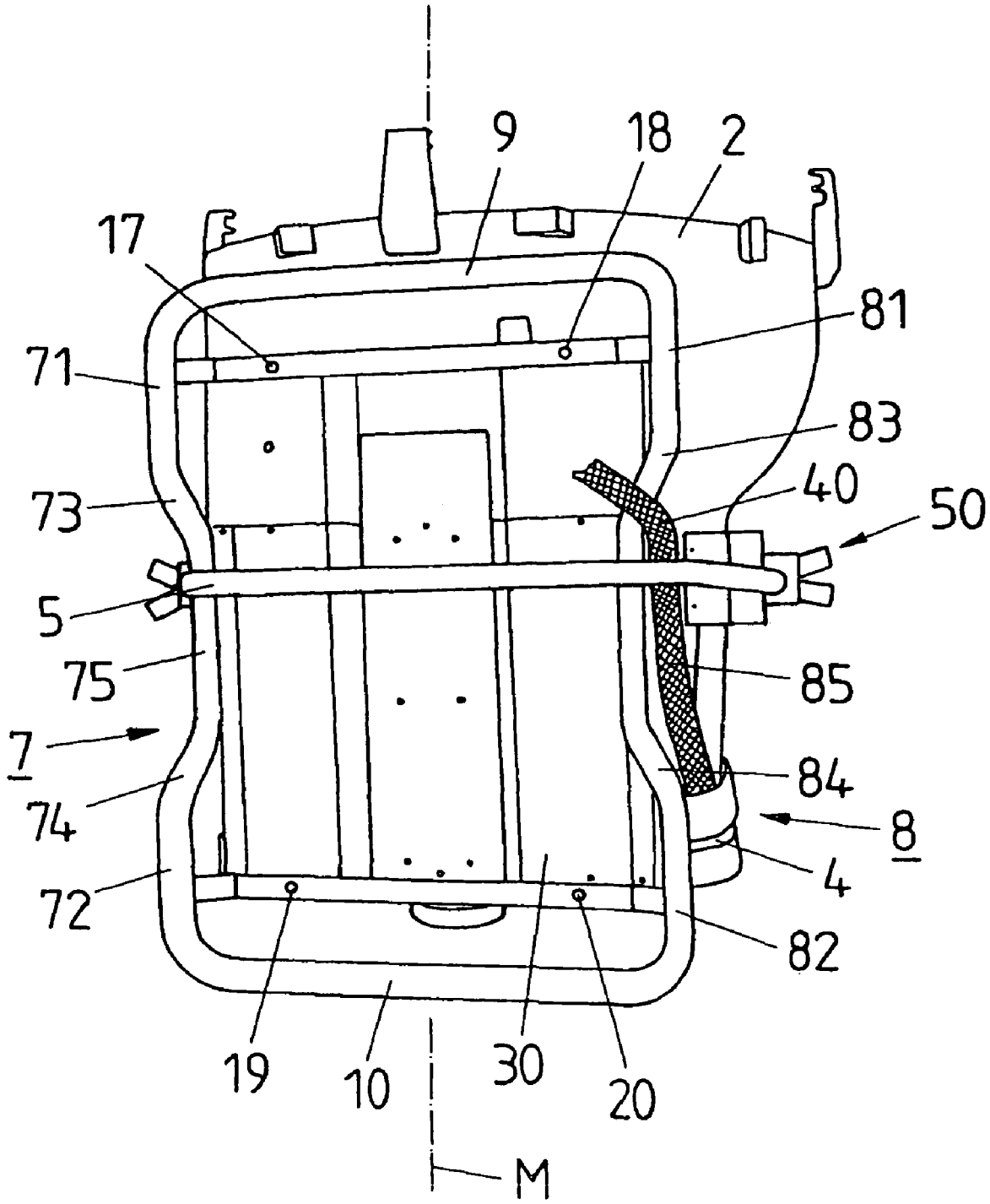

The perspective base view of a spotlight provided with a skid device 6 illustrated in FIG. 3 shows the connection of the base area 30 of the base pan 3 of the spotlight housing to the cross members 11, 12 of the skid device 6 via fastening elements 17, 18, 19, 20 which are inserted through the bores 13 to 16 (FIG. 2) of the cross members 11, 12. As can clearly be seen in the schematic perspective illustration according the FIG. 3, as a result of the angled section 83, 84, 85 of the skid 8, enough play is available for movement of the spotlight cable 40, which is led out of the cable bushing 4, between the bow 5, which is pivoted into the stand setting, and the skid device 6 for the laying of the spotlight cable 40, no constriction occurring which could constitute a risk to the spotlight cable 40, even in the case of an inclination change, that is to say a change in the position of the bow 5 compared to the base pan 3. The spotlight cable 40 can be moved to the front or rear side of the base pan 3 of the spotlight housing, as desired, and can be connected to a corresponding apparatus supplying electricity and exercising control.

LIST OF REFERENCE SYMBOLS

| | |
|---|---|
| 1 | Cylindrical lamp housing |
| 2 | Attachment part |
| 3 | Base pan |
| 4 | Cable bushing |
| 5 | Bow |
| 6 | Skid device |
| 7, 8 | Skids |
| 9, 10 | Cross tubes |
| 11, 12 | Cross members |
| 13-16 | Bores |
| 17-20 | Fastening elements |
| 30 | Base area |
| 40 | Spotlight cable |
| 50 | Bow linkage |
| 51, 52 | Bow arms |
| 53 | Connecting arm |
| 54 | Connecting pin |
| 55 | Housing rail |
| 56 | Bow bearing |
| 57 | Clamping lever |
| 71, 72 | End sections |
| 73, 74, 75 | Angled Section |
| 81, 82 | End sections |
| 83, 84, 85 | Angled Section |

The invention claimed is:

1. A skid device for a spotlight comprising a spotlight housing, a bow having two bow arms the ends of which are connected to bow linkages arranged diametrically opposite one another on the spotlight housing, a cable bushing on the spotlight housing connecting the spotlight to a spotlight cable, the skid device comprising:

two skids running parallel to the sides of the spotlight housing; and cross members connecting the skids to one another, said cross members having reception or fastening elements for connecting the skid device to the spotlight housing, said skids comprising end sections and angled sections between said end sections, said angled sections comprising first and second subsections and a third section lying there-between, said third sections being angled inward toward each other at least by a measure of a thickness of the spotlight cable, and said third sections defining a waist of the skid device.

2. The skid device of claim 1, wherein the skids form a rest of the skid device over the entire length of the skid device.

3. The skid device of claim 1, wherein at least one skid of said skids has a section angled to an optical axis of the spotlight whereby only the end sections of the skids form a rest of the skid device.

4. The skid device of claim 1, wherein the end sections of the skids are connected to one another via cross tubes.

5. The skid device of claim 4, wherein the cross tubes run parallel to the cross members.

6. The skid device of claim 4, wherein the cross tubes are angled from the ends of the skids in a direction of the spotlight housing.

7. The skid device of claim 1, wherein the cross members are connected to the end sections of the skids.

8. The skid device of claim 1, wherein the cross members are formed in the shape of a bow.

9. The skid device of claim 1, wherein the cross members have bores for receiving connecting elements connecting a base area of the spotlight housing to the skid device.

10. The skid device of claim 4, wherein the skids and the cross tubes consist Of metal tubes.

11. The skid device of claim 1, wherein cross tubes protrude at least over the base area of the spotlight housing which base area is connected to the skid device.

12. The skid device of claim 1, wherein the skids and cross tubes are integrally formed.

13. A skid device with a spotlight comprising a spotlight housing made from a cylindrical lamp housing and a cubical or polygonal base pan, a bow having two bow arms the ends of which are connected to bow linkages arranged diametrically opposite one another on the cylindrical lamp housing, a cable bushing on the base pan of the spotlight connecting the spotlight to a spotlight cable, the skid device comprising:

two skids running parallel to the sides of the base pan; and cross members connecting the skids to one another, said cross members having reception or fastening elements for connecting the skid device to the base pan of the spotlight housing, said skids comprising end sections and angled sections between said end sections, said angled sections comprising first and second subsections and a third section lying there-between, said third sections being angled inward toward each other at least by a measure of a thickness of the spotlight cable, and said third sections defining a waist of the skid device.

14. The skid device of claim 13, wherein the skids form a rest of the skid device over the entire length of the skid device.

15. The skid device of claim 13, wherein at least one skid has a section angled to an optical axis of the spotlight whereby only the end sections of the skids form a rest of the skid device.

* * * * *

UNITED STATES PATENT AND TRADEMARK OFFICE

CERTIFICATE OF CORRECTION

PATENT NO. : 7,703,953 B2
APPLICATION NO. : 11/990819
DATED : April 27, 2010
INVENTOR(S) : Timo Muller It is certified that error appears in the above-identified patent and that said Letters Patent is hereby corrected as shown below:

| **On the Title Page** | **In the inventors residence** |
|---|---|
| (75) Inventor: | Delete "Stephanskirchen" Insert -- Munich -- |

In the Claims

| | |
|---|---|
| Column 5, line 37 | Delete "for" Insert -- with -- |
| Column 6, line 22 | Delete "Of" Insert -- of -- |

Signed and Sealed this

Thirtieth Day of November, 2010

David J. Kappos

David J. Kappos
*Director of the United States Patent and Trademark Office*